United States Patent [19]

Hofmann

[11] Patent Number: 4,948,286

[45] Date of Patent: Aug. 14, 1990

[54] ORDERING MEANS FOR DOCUMENT FILES OR THE LIKE

[75] Inventor: Jorg Hofmann, Kreuzwertheim, Fed. Rep. of Germany

[73] Assignees: Gudrun Hofmann; Raimond Hofmann, both of Kreuzwertheim, Fed. Rep. of Germany

[21] Appl. No.: 173,974

[22] Filed: Mar. 28, 1988

[30] Foreign Application Priority Data

Apr. 10, 1987 [DE] Fed. Rep. of Germany ..... 3712097
Apr. 16, 1987 [DE] Fed. Rep. of Germany ..... 3713044

[51] Int. Cl.[5] ..... B42F 13/14; B42F 13/32
[52] U.S. Cl. ..... 402/34; 402/41
[58] Field of Search ..... 402/34, 38, 41

[56] References Cited

U.S. PATENT DOCUMENTS

| | | | |
|---|---|---|---|
| 2,789,561 | 4/1957 | Bonn et al. | 402/41 X |
| 4,415,290 | 11/1983 | Ohminato | 402/41 X |
| 4,449,840 | 5/1984 | Ohminato | 402/34 |
| 4,486,112 | 12/1984 | Cummins | 402/41 X |

FOREIGN PATENT DOCUMENTS

| | | | |
|---|---|---|---|
| 910531 | 5/1954 | Fed. Rep. of Germany . | |
| 1183048 | 12/1964 | Fed. Rep. of Germany | 402/34 |
| 3004830 | 8/1980 | Fed. Rep. of Germany | 402/38 |
| 8218793 | 10/1982 | Fed. Rep. of Germany . | |
| 36050 | 11/1910 | Sweden | 402/34 |

*Primary Examiner*—Paul A. Bell
*Attorney, Agent, or Firm*—Townsend & Townsend

[57] ABSTRACT

An ordering means for document files or the like comprises a base plate which is provided with at least two fixed ordering pins. At least one movable closure bow can be brought into closure contact with the ordering pins. Possibly a holder-down is provided which is adapted to be clamped with respect to the ordering pins. A locking member displaceable with respect to the base plate serves to adjust the closure bow or bows and on the base plate guide means are provided for guiding the locking member. The locking member is provided with guide slots or guide grooves via which the locking member is in engagement with each closure bow so that on displacement of the locking member the respective closure bow can be opened or closed.

16 Claims, 10 Drawing Sheets

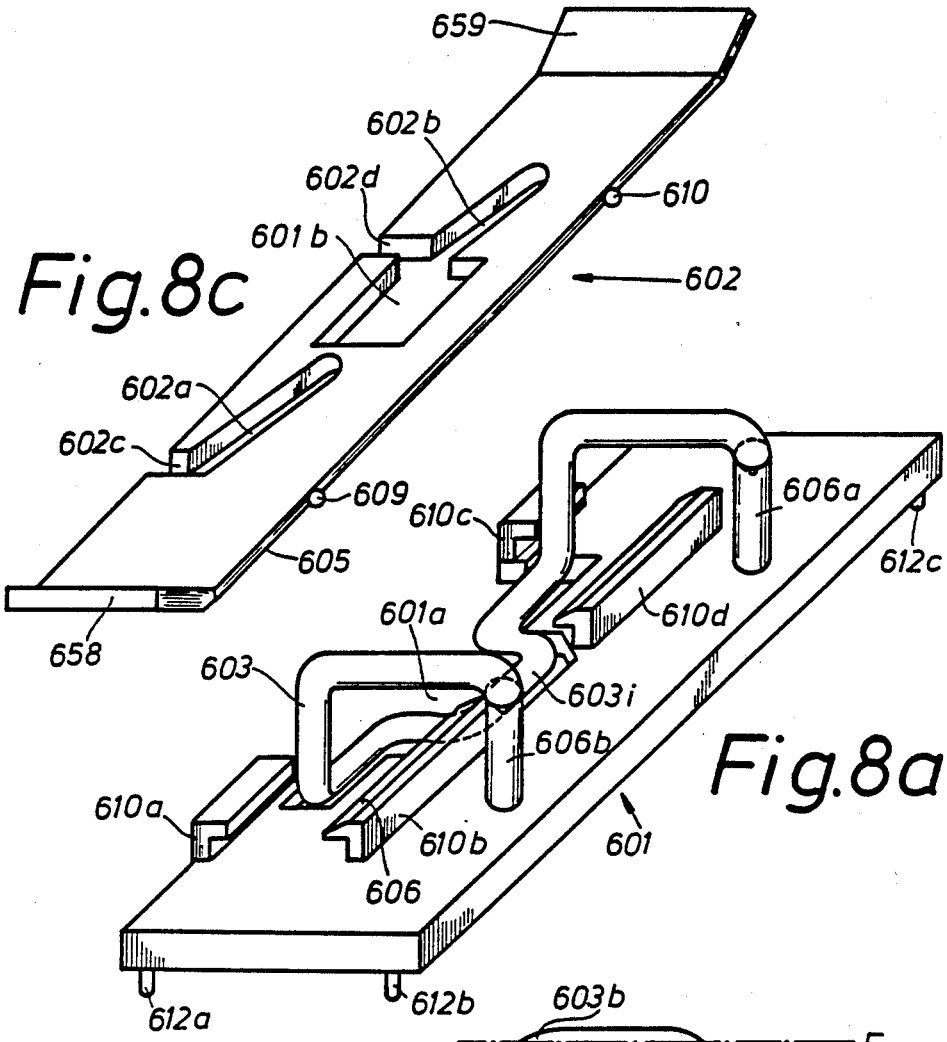
Fig.8c
Fig.8a
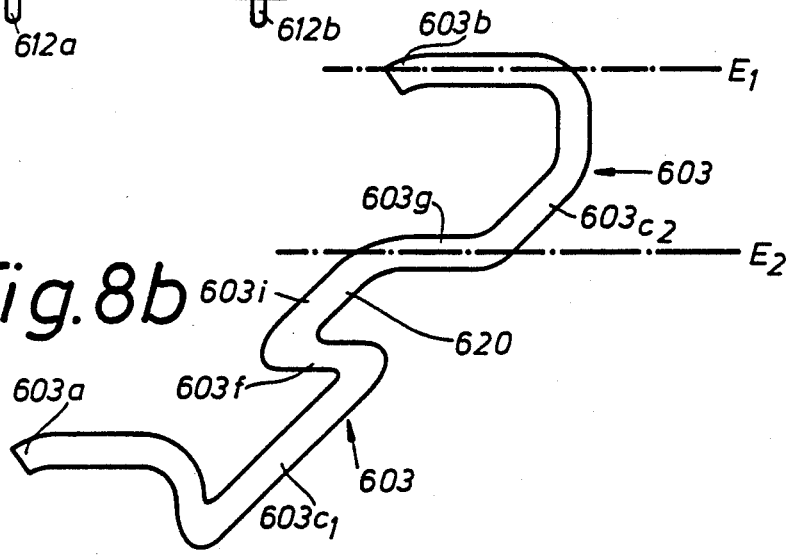
Fig.8b

ORDERING MEANS FOR DOCUMENT FILES OR THE LIKE

BACKGROUND OF THE INVENTION

The invention relates to a filing device for document files comprising a base plate having at least two stationary sheet retainers and at least one movable sheet retainer.

A filing device is known from DE-GM 82 18 793 and consists of a plurality of parts, for example 16 individual parts, which are mainly of metal and must be assembled before the filing device can be secured by means of rivets or the like in a file.

DE-PS 910,531 describes a further filing device in conjunction with a holding-down clamp which for holding down the documents to be ordered is clamped with respect to the stationary sheet retainers. This filing device also consists of a great number of individual parts which must be assembled in comparatively complicated manner before the means itself can be inserted in a file.

SUMMARY OF THE INVENTION

The invention is based on the problem of further developing a filing device of the type mentioned at the beginning in such a manner that it consists of a minimum number of parts which can easily and rapidly be assembled and in particular permit economic production.

This problem is solved according to the invention in that a locking member displaceable with respect to the base plate is provided, guide means being arranged on the base plate for guiding the locking member, and that the locking member has guide slots or guide grooves via which the locking member is in engagement with each movable sheet retainer and on displacement of the locking member the respective movable sheet retainer is opened or closed.

The invention provides a filing device which in the basic construction consists of only four or five individual parts. A base plate on which the stationary sheet retainers are integrally formed projecting vertically upwardly comprises openings for insertion of the movable sheet retainer or movable sheet retainers and guide means for a locking member which is displaceable in the direction of the longitudinal axis of the base plate for the purpose of opening and closing the movable sheet retainer or retainers. Preferably, the base plate, the locking member, the holding-down clamp and the stationary sheet retainers consist of plastic whilst the movable sheet retainer or shackle consists in known manner of metal or alternatively also of plastic, preferably of glass-fiber reinforced plastic. Thus, as required some or all of said individual parts may be made from metal or plastic.

The filing device according to the invention is particularly suitable for use in document files or the like with small or medium back width but can also be used on appropriate formation of the locking member for large document files, i.e. for files of large stack height in which a comparatively large opening angle of the movable sheet retainer or retainers is desired. The holding-down clamp consists according to the present invention preferably of plastic and has no additional means, for example in the form of spring wires or the like serving for clamping with respect to the stationary sheet retainers.

Hereinafter preferred embodiments of the filing device will be described for explaining further features with the aid of the drawings, wherein:

BRIEF DESCRIPTION OF THE DRAWINGS

FIG. 8*a* to 8*c* show a further modification of the filing device compared with FIG. 1 and 2.

DETAILED DESCRIPTION OF THE PREFERRED EMBODIMENT

Figure 1:
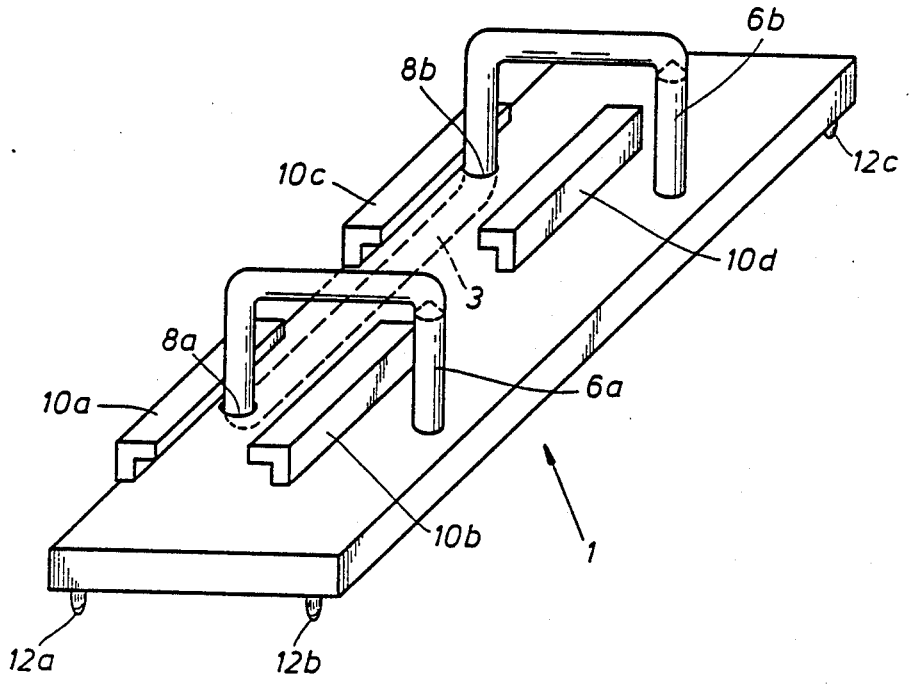
FIG. 1 is a perspective view of the base plate according to a first embodiment.
Figure 2:
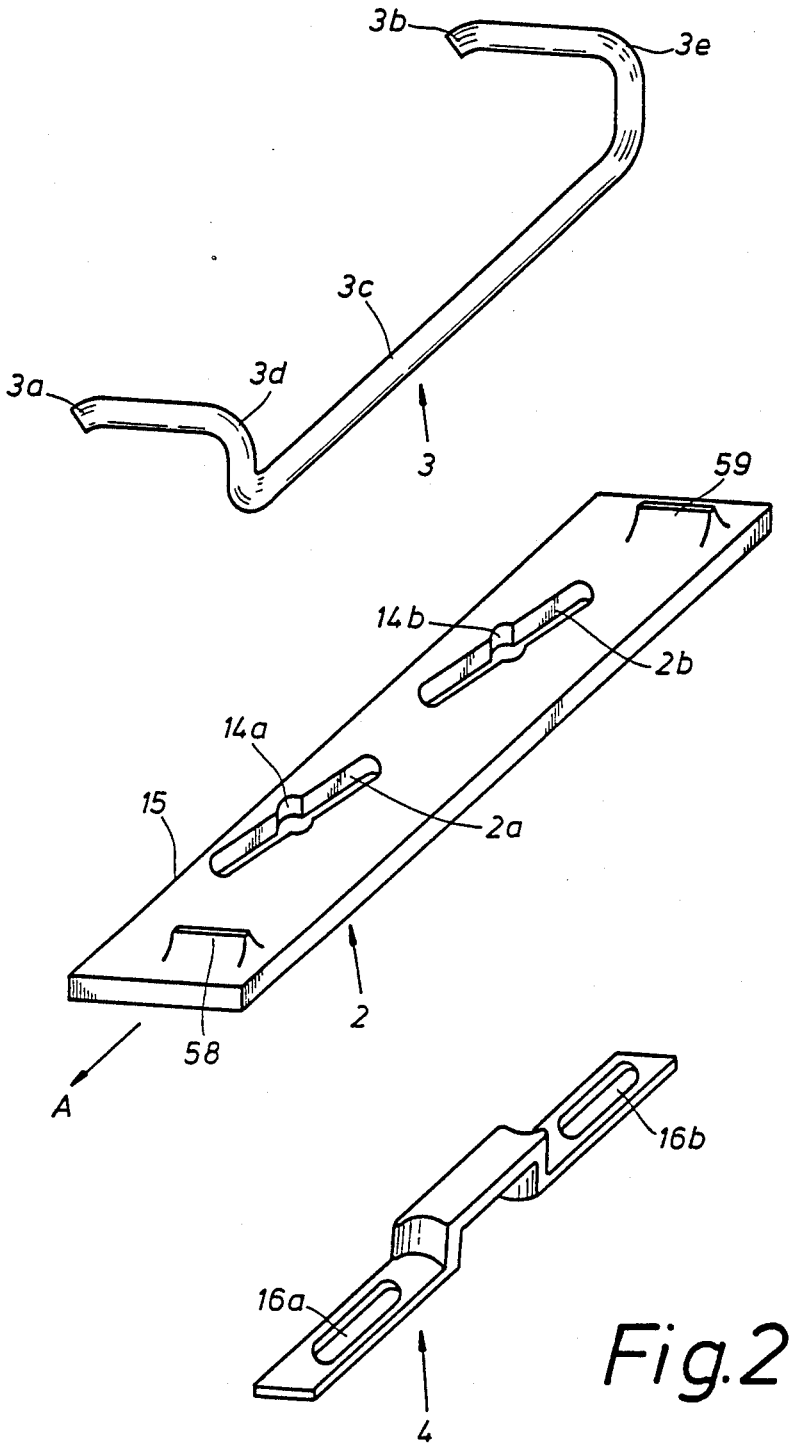
FIG. 2 is an exploded perspective view of the locking member, the movable sheet retainer, and the holding-down clamp for the first embodiment.

FIGS. 1 and 2 show a first preferrred embodiment of a filing device for document files or the like which consists of a base plate 1, a locking member 2, a movable sheet retainer 3 and holding-down clamp 4.

On the base plate 1 which preferably has a substantially rectangular shape, at least two stationary sheet retainers 6*a*, 6*b* are provided which project upright form the base plate 1 and at their free end have an engagement face for the free ends of a movable sheet retainer 3 of bow-like shape. The stationary sheet retainers 6*a*, 6*b* may be formed as integral parts of the base plate or secured as metal pins to the base plate 1. The base plate 1 is provided on the side remote from the stationary sheet retainers 6*a*, 6*b* with opening or bores 8*a*, 8*b* serving for passage of the movable sheet retainers 3. The movable sheet retainer 3 (FIG. 2) is led from the lower side of the base plate 1 through the openings 8*a*, 8*b* in such a manner that the free ends 3*a*, 3*b* of the movable sheet retainers are adapted to engage the stationary sheet retainers 6*a*, 6*b* in such a manner that with the form of the movable sheet retainer 3 shown in FIG. 2 the curved portions 3*d*, 3*e* bent up from the elongated connecting portion 3*c* come to lie in the regions of the openings 8*a*, 8*b*. The bend portions 3*e*, 3*d* project upwardly substantially vertically from the connecting portion 3*c* and merge into the substantially extending end portions as shwon in FIG. 2. The movable sheet retainer 3 thus has substantially as a whole the form of a horn. The elongated connecting portion 3*c* between the two retainer ends 3*a*, 3*b* remains in this embodiment beneath the base plate 1 or in engagement with the lower surface of the base plate 1 so that the movable sheet retainer 3 is mounted in the openings 8*a*, 8*b* pivotally with respect to the base plate 1. Before insertion of the movable sheet retainer 3 through the openings 8*a*, 8*b* of the base plate 1 the locking member 2 is inserted into guide means formed on the upper side of the base plate 1. The locking member 2 is brought into a position such that the movable sheet retainer 3 can be inserted in simple manner through the openings 8*a*, 8*b* in the base plate 1 on the one hand and through the openings or slots 2*a*, 2*b* of the locking member on the other hand and thus into the operating position.

As guide means in the embodiment of FIG. 1 rails or lugs 10*a*, 10*b*, 10*c*, 10*d* are provided which have a substantially L-shaped profile and of which the guide rails 10*a*, 10*c* and 10*b*, 10*d* respectively are provided one behind the other on the upper surface of the base plate 1 and form a guide groove. The guide rails 10*a*, 10*b* on the one hand and the guide rails 10*c*, 10*d* on the other hand lie opposite each other so that the displacement of the locking member is fixed in a direction extending parallel to the longitudinal axis of the base plate 1. The L-shaped guide rails 10*a* to 10*d* engage over the locking member 2 and thus prevent a shifting of the locking member 2 upwards away from the base plagte 1. Although in this embodiment the guide rails 10 to 10*d* engage over the locking member 2, they may be made if required also as simple strips which do not engage over the locking member 2 so that only a lateral guiding for the locking member 2 is provided. Fundamentally, instead of the guide rails 10*a* to 10*d* shown in FIG. 1 guide pins or the like may be provided which by notches have a profile corresponding to the guide rails 10*a* to 10*d* of FIG. 1 or a circular cross-section. In known manner at the lower side of the base plate 1 pins 12*a*, 12*b*, etc. are provided which serve to secure the base plate 1 to the document file.

As clearly apparent from FIG. 2 the locking member 2 consists according to a first embodiment of a plate-shaped part which has slots 2*a*, 2*b* extending inclined to its longitudinal axis or to the longitudinal axis of the base plate 1. The slots 2*a*, 2*b* are arranged parallel to each other and may be provided in the center with a widened opening 14*a*, 14*b* which define a larger internal diameter than the diameter of the movable sheet retainer 3 and serve for easy insertion of the movable sheet retainer 3. The slots 2*a*, 2*b* have laterally of the widened opening a width corresponding substantially to the outer diameter of the movable sheet retainer 3.

If within its limited displacement region defined by the guide means 10*a*, 10*d*, the slots 2*a*, 2*b* and the portions of the sheet retainer 3 inserted through the slots 2*a*, 2*b*, the locking member 2 is located in a position in which the movable sheet retainer ends or the bent regions 3*d*, 3*e* of the movable sheet retainer come to lie within the widened bores 14*a*, 14*b* the movable sheet retainer 3 can then be freely pivoted over a predetermined region about its axis defined by the longitudinal portion 3*c*. The displacement of the locking member 2 parallel to the base plate 1 in the direction of the arrow A causes the movable sheet retainer 3, due to the inclined slots 2*a*, 2*b* to move in the direction towards the stationary sheet retainers 6*a*, 6*b* whilst a displacement of the locking member 2 opposite to the direction of the arrow A causes an opening of the sheet retainer 3. This function applies for the locking member 2 in which the slots 2*a*, 2*b* starting from the widened bore 14*a*, 14*b* extend in the direction of the arrow A to the nearest outer edge 15 of the locking member 2 inclined as shown in FIG. 2. As soon as the locking member 2 has been displaced in the direction of the arrow A into the end position defined by the one end of the slot 2*a* and 2*b* the sheet retainer 3 has reached its closure position, whereupon the holding-down clamp 4 previously placed on the stationary sheet retainers 6*a*, 6*b* can be brought into a clamping position for holding down the documents or the like. The holding-down clamp may be formed by a plate-shaped element or by a stirrup-shaped element according to FIG. 2 which comprises an elevation in the center and is provided laterally of the elevation with clamping slots 16*a*, 16*b*. Said clamping slots 16*a*, 16*b* lie parallel to each other in the direction of the longitudinal axis of the plate-shaped member. Said slots 16*a*, 16*b* referred to as clamping slots have a taper arch in the same direction so that on displacement of the holding-down clamp 4 oppositely for example to the direction of the arrow A in the embodiment shown in FIG. 2 the stationary sheet retainers 6*a*, 6*b* coming to the region of smaller slot width and the holding-down clamp 4 is thus clamped to the stationary sheet retainers. The clamping slots 16*a*, 16*b*, as can be seen, have at their one end a width which is greater than the diameter of the stationary sheet retainers and at the other end a width which is slightly less than the diameter of the stationary sheet retainers 6*a*, 6*b*.

Although the holding-down clamp 4 according to FIG. 2 has the form of a stirrup it is apparent that it could have a completely planar form; however, advantageously a grip or lug portion is provided for gripping by means of the fingers the holding-down clamp 4 to enable the latter to be brought out of the clamping position into the freely displaceable position and vice versa.

Figure 3:
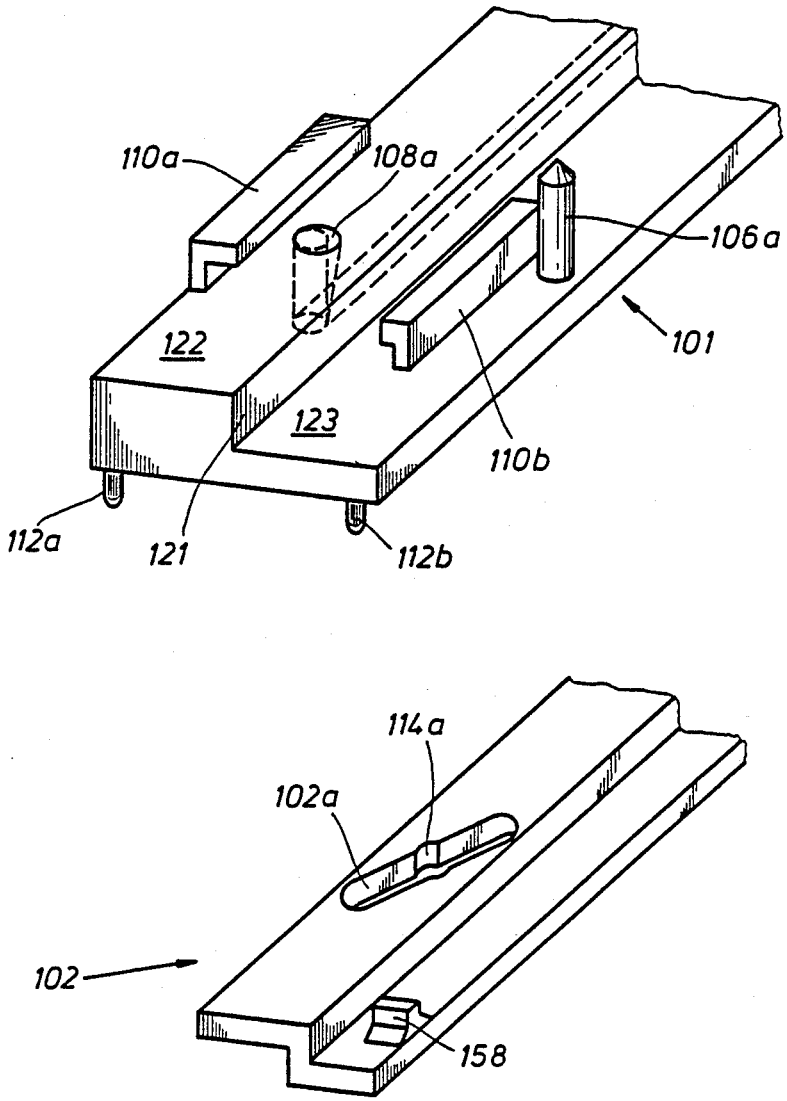
FIG. 3 shows a second embodiment of the filing device in which the upper surface of the base plate and the locking member have an angled shape.

FIG. 3 shows an embodiment of a filing device modified compared with FIGS. 1 and 2. The essential difference of the embodiment of FIG. 3 compared with the embodiment of FIGS. 2 and 2 resides in that the base plate 101 between the guide rails 110*a*, 110*c* and 110*b* has a step 121 so that the guide rails or guide means 110*a*, 110*c* come to lie at a higher level than the guide means 110*b*, 110*d*. This means that the surface of the base plate 1 according to FIG. 3 is in two spaced-apart planes, the spacing being governed by the step 121. The locking member 102 in the embodiment of FIG. 3 accordingly has an angled profile so that a displacement of the angled locking member 102 longitudinally of the base plate 101 is possible. As apparent from FIG. 3 on displacement of the locking member 102 a shifting of the inclined slots 102*a*, 102*b* along the higher surface 122 of the locking member 102 is effected, the openings 108*a*, 108*b* being provided in the higher surface 122 and the stationary sheet retainers 106*a*, 106*b* at the lower surface 123. The openings 108*a*, 108*b* have a form corresponding for example to a truncated cone, the larger opening face lying in the surface 122. The walls of the openings 108*a*, 108*b* extend in particular close to the step designated by 121 inclined with respect to the latter. In this embodiment a larger pivot range of the movable sheet retainer 103 is possible and thus a greater opening angle between the sheet retainer 103 and the stationary sheet retainers 106*a*, 106*b*. The reason is that the distance between the axis of rotation of the sheet retainer 103 and the surface 122 as support for the locking member 102 controlling the pivot mevement of the sheet retainer 103 is substantially greater than in FIGS. 1 and 2. The associated pairs of guide rails 110*a*, 110*b* and 110*c*, 110*d*, provided opposite each other, are thus each on a different level. Instead of these guide rails 110*a* to 110*d* of L-shaped profile as descriebed in conjunction with FIGS. 1 and 2 other guide elements may also be used.

Figure 4:
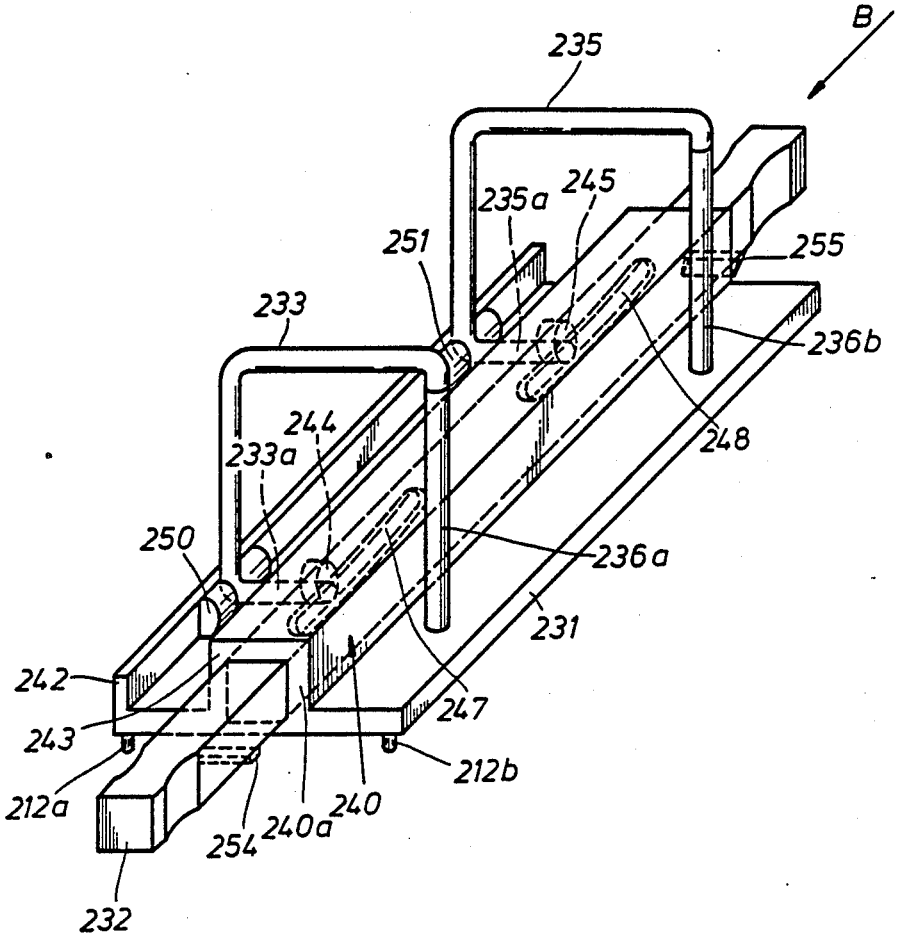
FIG. 4 is a third form of the filing device.

FIG. 4 shows a further modified embodiment of the filing device. Said filing device consists of a base plate 231, a locking member 232, at least two movable sheet retainers 233, 235 and a holding-down clamp 204 of the type described in connection with FIGS. 1 to 3 and not illustrated in FIG. 4. Provided vertically upright on the base plate 231 are stationary sheet retainers 236*a*, 236*b* which cooperate with the movable sheet retainers 233, 235. As guide means a guide passage 240 is provided in the base plate 231 and is integrated into said base plate 231 or provided on said base plate 231 and has a cross-sectional form adapted to the locking member 232. In the example of embodiment illustrated the locking member 232 has a square cross-section and consequently the guide passage 240 defines a square guide face making displacement of the locking member 232 along the guide passage 240 possible. Instead of a continuous guide passage 240 individual guide passage sections may be formed on or in the base plate 231.

In this embodiment the guide passage or channel 240 serves not only to guide the locking member 232 on movement for opening and closing the movable sheet retainers 233, 235, but also to hold the movable sheet retainers 233, 235 themselves. For this purpose the guide channel or passage 240 comprises locally vertical slots 244, 245 in a side wall 243 opposite a web 242. The web 242 extends along the one end of the base plate 231 upwardly from the latter at an angle of about 90° . The slots 244, 245 permit a vertical displacement of the movable sheet retainers 233, 235 inserted in each of said slots 244, 245. Each movable sheet retainer 233, 235 comprises a substantially U-shaped form, the leg designated by 233*a* and 235*a* being inserted substantially parallel to the base plate 231 and pushed through the associated slot 244, 245 through the side wall 243 into the guide passage 240. In this manner the respective leg 233*a*, 235*a* reaches a guide groove 247, 248 extending inclined or curved and associated with said leg, said groove being worked from the side wall 243 into the locking member 232. Due to the inclination or the curved path of the guide groove 247, 248 in conjunction with the vertical slot 244, 245 on displacement of the locking or control member 232 in the direction of the arrow A a raising of the movable sheet retainer 233, 235 is effected and in the converse direction a lowering. The web 242 serves as abutment for the knee of the movable sheet retainer 233, 235 adjacent the leg 233*a*, 235*a* respectively whilst the depth of the guide grooves 247, 248 in the locking member 232 is made large enough for the knee of each sheet retainers 233, 235 to remain in engagement with the web 242. A movement of the sheet retainers 233, 235 with respect to the base plate 231 after insertion thereof into the position shown in FIG. 4 is prevented by bearings 250, 251 which in accordance with one embodiment each consist of two portions. The associated bearing portions are spaced apart a distance corresponding to the thickness of the sheet retainers 233, 235 and disposed at the edge 242 pointing towards the guide passage 240. The bearing portions define between them a gap which extends transversely of the arrow direction B and serves as mounting in particular for the knee region of the respective sheet retainer 233, 235 adjacent the leg 233*a*, 235*a*. Depending on the movement of the locking member 232 in the direction of the arrow B or opposite thereto it is thus to effect raising and opening of the sheet retainer 233, 25 or lowering and closing of the sheet retainer 233, 235.

In the embodiment illustrated in FIG. 4 the locking member 232 may be displaced substantially above the upper surface of the base plate 231 in the longitudinal direction of the latter, i.e. the guide channel 240 is formed substantially on the base plate 231. The locking member 232 is inserted oppositely to the direction of the arrow B from the end side designated by 240*a* of the guide passage 240 into the latter and thereafter in succession of the sheet retainer 233 and the sheet retainer 235 are inserted via the vertical slots 244 and 245 respectively into the associated guide groove 247, 248 and subsequently the sheet retainers 233, 235 still inclined to the base plate 231 are engaged in the mounting formed by a notch. To prevent unintentional pushing of the locking member 232 out of the guide passage 240 said locking member comprises near its one end a stop 254 provided at its lower surface whilst at the opposite end the locking member is provided likewise at its lower surface with a catch member 255 which is attached as flexible tab to the locking member 232 extending downwardly in the direction of the arrow B. This makes possible insertion of the locking member 232 through the guide passage 240 until said member reaches the position shown in FIG. 2 after emerging from the rear opening (FIG. 4) of the guide passage and the catch member 255 snaps downwardly and limits the movement of the locking member 232 in the direction of the arrow B.

All the individual parts are made from plastic, preferably glassfiber reinforced plastic. The stationary sheet retainers 206*a*, 206*b* or 236*a* and/or the movable sheet retainers 233, 235 consist of plastic or metal, preferably glassfiber reinforced plastic. Preferably the individual parts described are made from glassfiber reinforced plastic, thereby giving adequate stability. To ensure easy handling of the locking members 202, 232 the latter may be provided in accordance with FIGS. 2 and 3 with projections which facilitate manipulation thereof on displacement.

The guide slots 202*a*, 202*b* or guide grooves 247, 248 may be formed as rectilinearly extending slots or curved slots and substantially govern the degree of opening of the sheet retainers for a predetermined mevement travel of the associated locking member.

The embodiments described each have two sheet retainers or two sheet retainer pairs. It is obvious that the number of sheet retainers can be increased if documents having more than two punched holes are to be filed.

A filing device for document files or the like as explained above comprises a base plate which is provided with at least two fixed stationary sheet retainers. At least one movable sheet retainer can be brought into closure contact with the stationary sheet retainers. Possibly a holding-down clamp is provided which is adapted to be clamped with respect to the stationary sheet retainers. A locking member displaceable with respect to the base plate serves to adjust the sheet retainter or retainers and on the base plate guide means are provided for guiding the locking member. The locking member is provided with guide slots or guide grooves via which the locking member is in engagement with each sheet retainer so that on displacement of the locking member the respective sheet retainer can be opened or closed.

Figure 5A:
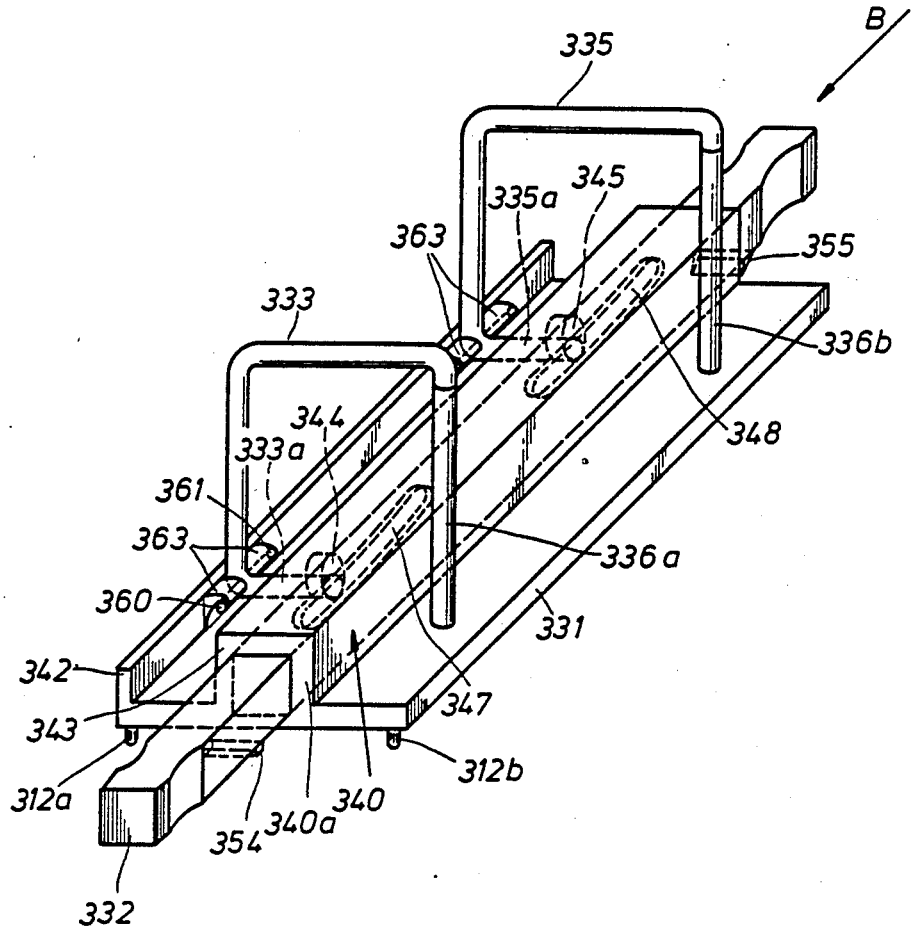
FIGS. 5*a* and 5*b* show an embodiment modified compared with FIG. 4.
Figure 5B:
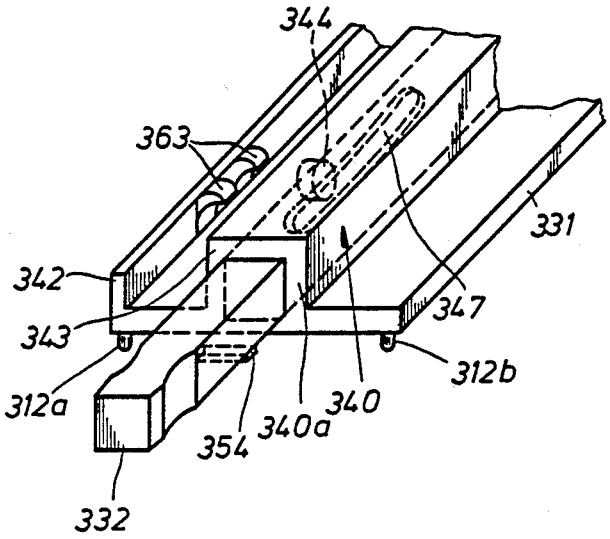
Figure 5B:
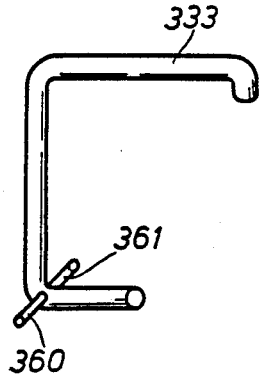

The embodiment shown in FIGS. 5*a* and 5*b* is modified compared with the embodiment of FIG. 4. According to FIGS. 5*a* and 5*b* on each of the movable sheet retainers 333, 335 bearing pins 360, 361 are provided which extend laterally of said movable sheet retainers and are formed at the curve following the portion 333*a* and 335*a* respectively and form a "cross" together with the respective movable sheet retainer. Said bearing pins 360, 361 serve to define an axis of rotation of the retainer 333 and are engaged by bearing portions 363 as soon as the associated retainer is inserted in the manner illustrated in FIG. 5*a*. The two bearing portions 363 associated with each other are spaced a distance apart corresponding substantially to the thickness of the movable sheet retainer 333 and are made projecting at the edge in the direction towards the guide passage 343. As a result the bearing portions 363 form a mounting for the bearing pins 360, 361 and prevent the movable sheet retainers 333, 335 from springing out of the plate 331 upwardly. It is apparent from FIG. 5*b* that the bearing pins 360, 361 extend perpendicularly to the plane of the associated movable sheet retainer 333 and 335 respectively. The two bearing pins 360, 361 lying on a common axis.

Figure 6A:
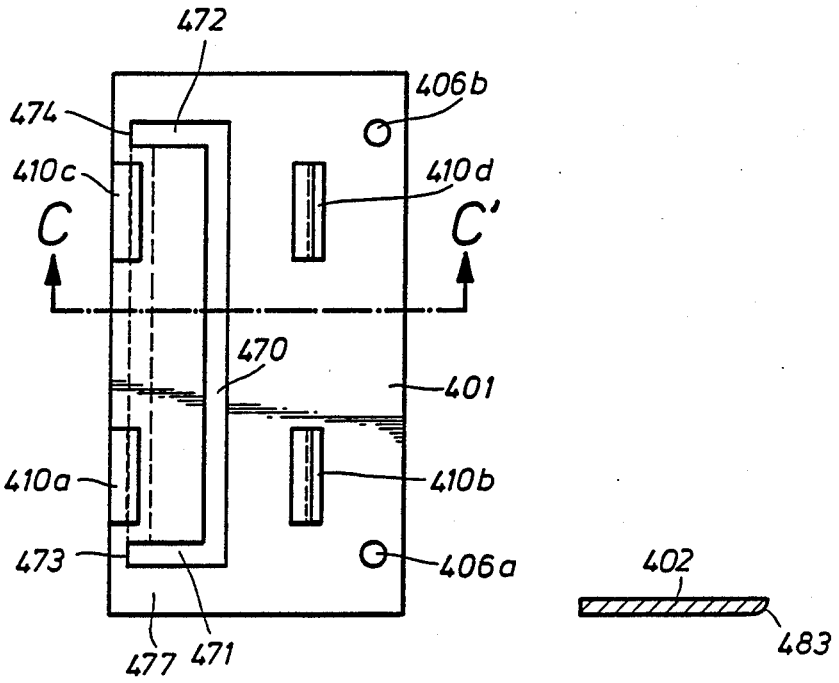
FIG. 6*a* is a plan view of a modified embodiment of the base plate.
Figure 6B:
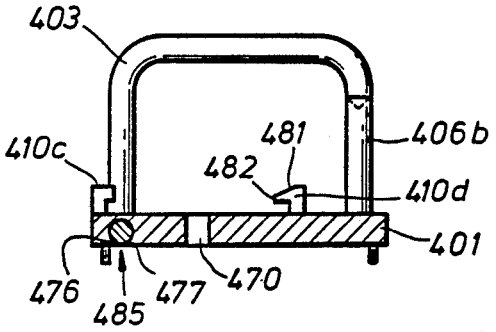
FIG. 6*b* is a sectional view of an filing device with the base plate according to FIG. 6*a* along the line C—C and a sectional view through the associated locking member.

FIGS. 6*a* and 6*b* show a further modification of the filing device according to the invention. The filing device according to FIG. 6*a* and 6*b* correspond substantially to the embodiment described with reference to FIG. 1; in FIGS. 6*a* and 6*b* parts identical to the embodiment of FIGS. 1 to 3 are not explained in detail. In so far as the embodiment of FIGS. 6*a* and 6*b* corresponds to the embodiment of FIGS. 1 and 2 the description of identical parts seems to be superfluous.

A difference compared with the embodiment of FIG. 1 in that of FIG. 6*a* is that a slot 470 is provided which extends in the axial direction of the plate 1 and which has a length which corresponds at least to the length of the leg portion 403*c* of the movable sheet retainer 3 (FIG. 2) and permits insertion of the movable sheet retainer 403, as the latter is described in conjunction with FIG. 2, from the upper side of the base plate 1. The movable sheet retainer 403 is inserted into the slot 470 in such a manner that its bow ends 403*a*, 403*b* are directed towards the stationary sheet retainers 406*a*, 406*b*. The width of the slot 470 is made slightly greater than the thickness of the movable sheet retainer 403. After insertion of the movable sheet retainer 403 with its base portion 403*c* into the slot 470 the movable sheet retainer is displaced in FIG. 6*a* towards the left along the guide slots 471, 472. The guide slots 471, 472 directly adjoin the slot 470 at the opposite ends thereof at an angle of about 90° and terminate at 473, 474 at a corresponding distance from the left edge of the base plate 301 in FIG. 6*a*. In the embodiment of FIG. 6*a* the guide slots 471, 472 are preferably formed symmetrically with the center transverse axis of the base plate 401, said axis not being shown, and as a result a preferably central arrangement of the movable sheet retainer 403 is obtained. To mount the movable sheet retainer 403 firmly after its displacement out of the slot 470 via the guide slots 471, 472 at the ends 473, 474 a receiving groove 485 is provided in the lower surface of the base plate 401 with detent noses 476, 477. As soon as the movable sheet retainer 403 comes to lie with its base 403*c* beneath the receiving grove 485 it is drawn upwardly and due to the detent noses 476 477 snaps firmly into the receiving groove 485.

Whereas in the embodiment of FIGS. 1 and 2 the movable sheet retainer 3, as described, must be pushed from the lower side of the base plate 1 through openings 8*a*, 8*b*, in the embodiment of FIGS. 6*a* and 6*b* a simplified insertion of the movable sheet retainer 403 is possible in the manner explained. The movable sheet retainer 403 can be provided with the threaded-on locking member 402, i.e. fitted onto the movable sheet retainer 403, so that the locking member after engagement of the sheet retainer into the detent noses 476, 477 can be introduced by slight tilting with its one edge face 415 beneath the guide rails or guide elements 410*a*, 410*c*. Thereafter the locking member 402 is "snapped in" beneath the guide rails 410*b*, 410*d* in the region of its guide edge opposite the guide edge 415. For this purpose the guide rails 410*b*, 410*d* are made extending inclined in the manner shown in FIG. 6*b* so that the guide rails 410*b* and 410*d* in sectional view have the form of a hook and the upper surface 481 extends downwardly inclined towards the hook tip 482. The locking member 402 shown in sectional view in FIG. 6*b* is formed in corresponding manner in the region of its edge 483 facing the guide rails 410*b*, 410*d*, i.e. The edge is rounded at its downwardly directed face, facilitating the snapping in of the locking member 402 and the insertion of said member into the guide groove defined by the guide rails 410*b*, 410*d* into an arrangement substantially parallel to the base plate 401. Due to the fact that the guide rails 410*b*, 410*d* extend from the tip 482 in the direction towards the vertical wall of each guide rail 410*d*, 410*b* substantially rectilinearly, i.e. parallel to the base plate 401, unintentional snapping of the locking member 402 out of the guide grovve defined by the guide rails 410*b*, 410*d* is prevented. After the insertion of the movable sheet retainer 403 the base portion 403*c* of the sheet retainer 403 is in the receiving groove 485 at the lower side of the base plate 401 (FIG. 6*b*) which is formed parallel to the longitudinal axis of the base plate 401 in the lower side of said plate and thus projecting of the base portion 403*c* beyond the lower surface of the base plate 401 is avoided. The detent noses 476, 477 prevent the base portion 403*c* slipping out of the receiving groove 485 (downwardly).

Figure 7C:
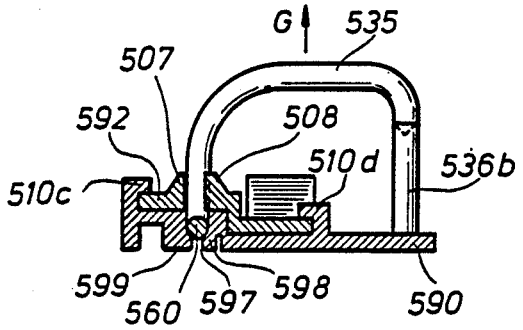
FIG. 7*c* is a sectional view through the filing device according to FIG. 7*a* along the line D—D'.
Figure 7A:
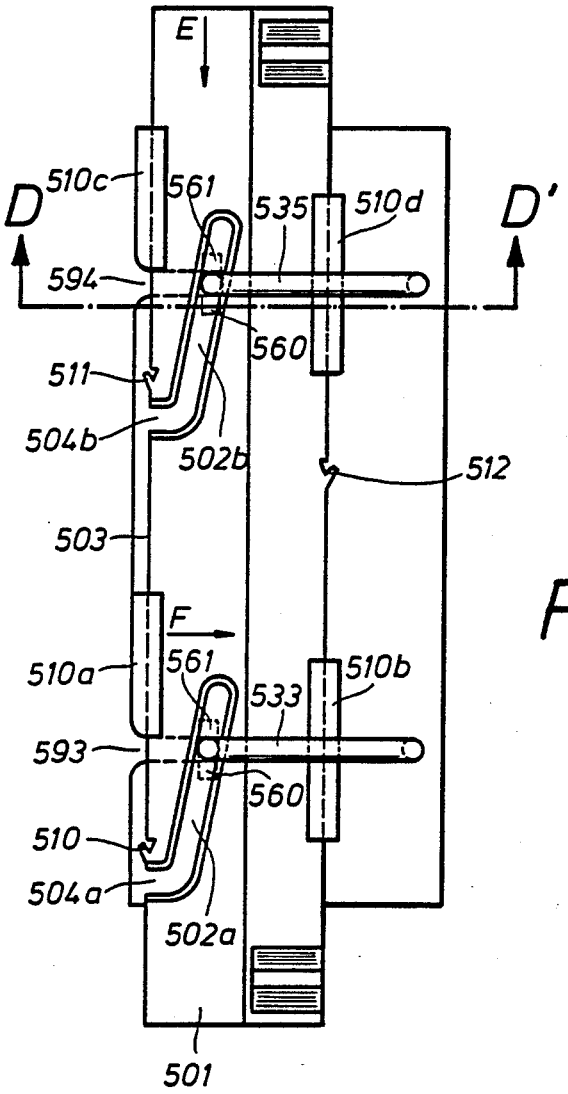
FIG. 7*a* is a plan view of a modified embodiment of the filing device.
Figure 7B:
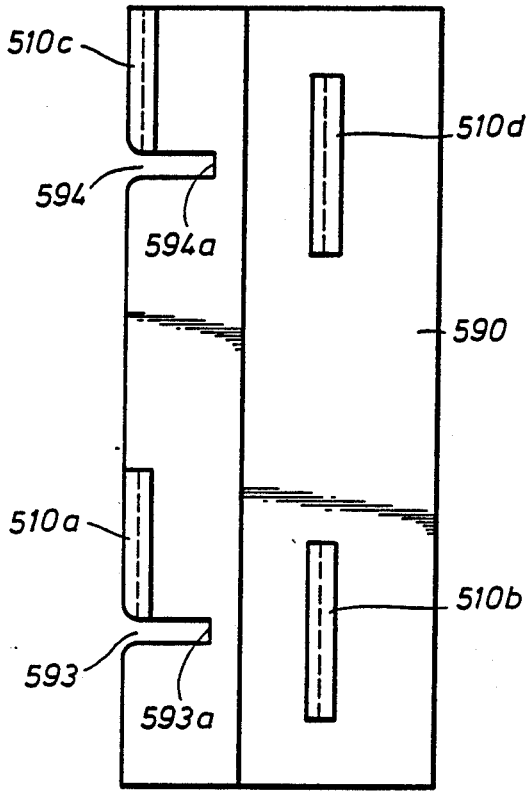
FIG. 7*b* is a plan view of the base plate.

FIGS. 7*a*, 7*b* and 7*c* show a modified embodiment of the filing device compared with the embodiment of FIGS. 5*a* and 5*b* and according to FIGS. 7*a*, 7*b* and 7*c* individual movable sheet retainers 533, 535 of the type described in conjunction with FIGS. 5*a* and 5*b* are used. FIG. 7*a* is a plan view of the filing device with inserted movable sheet retainers 533, 535 which each have laterally projecting bearing pins 560, 561 which are indicated in dashed line in FIG. 7*a*. The base plate 590 has according to FIGS. 7*a* to 7*c* a substantially stepped profiling similar to that described in conjunction with FIG. 3, said stepped or staircase profiling of the base plate 590 serving to increase the opening mevement of the movable sheet retainers 533, 535 and to simplify the insertion of the larger stacks of paper. In corresponding manner the locking member, which is denoted by 591, is also made stepped in cross-section, guide rails 510*a*, 510*b*, 510*c* and 510*d* serving to guide the locking member 591 corresponding to FIGS. 1 to 3. As indicated in FIGS. 7*a* and 7*b* said guide rails are preferably offset with respect to each other, i.e. The pairs 510*a*, 510*b* on the one hand and 510*c* and 510*d* on the other do not lie above each other as provided in the embodiment of FIGS. 1 to 3 but mutually offset with respect to the longitudinal axis. The base plate 590 comprises for example introduction slots 593, 594 which extend centrally with respect to the guide rails 510*b*, 510*c* and which from the left side of the base plate 590 in FIG. 7*b* extend over a predetermined depth into said base plate 590. The end of each introduction slot 593, 594 denoted by 593*a* and 594*a* lies on a line in the longitudinal direction of the base plate 590 which is slightly laterally offset with respect to the desired axis of rotation of the two movable sheet retainers 533, 535. The introduction slots 593, 594 are provided in order to introduce the movable sheet retainer 533, 535 from the side face of the base plate 590 denoted by 595 into said base plate. During the introduction operation of the movable sheet retainer 533, 535 the latter are held by hand or in another manner in such a manner that the bearing pins 560, 561 lie beneath the lower surface of the base plate 590, whereupon the movable sheet retainers are displaced in the manner still to be described in the direction towards the guide rails 510*b* and 510*d*, i.e. transversely of the longitudinal direction of the base plate, until the bearing pins 560, 561 come to lie beneath the detent grooves, of which only one, denoted by 597, is shown in FIG. 7*c*. Thereafter the movable sheet retainers 533, 535 are moved upwardly in such a manner that the bearing pins 560, 561 overcome the forces generated by detent noses 598, 599 and engage into the associated detent groove 597. The detent grooves 597 serve for locking reception of the bearing pins 560, 561, as will be described below in conjunction with FIG. 7*c*.

The detent grooves 597 are formed on the lower side of the base plate 590 and fixed by lateral detent noses 598, 599 which prevent the bearing pins 560, 561 from coming out of the detent groove 597.

The locking member designated by 501 in FIG. 7*a* comprises like the locking member of FIG. 3 inclined slots 502*a*, 502*b* which exert the same function as described in conjunction with FIGS. 1 to 3. The slots 502*a*, 502*b* are however not closed at their end towards the left guide edge 503 in FIG. 7*a* but open towards said guide edge 503. This means in other words that the inclined slots 502*a*, 502*b* merge into a guide portion 504*a*, 504*b* extending transversely of the guide edge 503, the slots 502*a*, 502*b* and the guide portions 504*a*, 504*b* having a width corresponding substantially to the thickness of the movable sheet retainers 533, 535.

Introduction of the movable sheet retainer 533, 535 is as explained below. After preparation of the base plate 590 the locking member 501 is pushed for example in FIG. 7*a* from above in the direction of an arrow E into the guide rails 510*c*, 510*d* and then further until the locking member also slides in the guide rails 510*a*, 510*b*. The insertion operation of the locking member 501 in the direction of the arrow E is continued until the guide portions 504*a*, 504*b* formed in the transverse direction of the locking member 501 in the latter come into coincidence with the insertion slots 593, 594 of the base plate 590. The locking member 501 is stopped and left in this position so as to permit the insertion of the movable sheet retainers 533, 535. The movable sheet retainers 533, 535 are inserted from the side denoted by 503 into the insertion slots 593, 594 and at the same time into the guide portions 504*a*, 504*b*, the bearing pins 560, 561 being disposed beneath the base plate 590, i.e. out of engagement with said base plate 590. Thereafter the locking member 501 is pushed further in the direction of the arrow E, resulting in a displacement of the movable sheet retainers 533, 535 in the direction of the arrow F, i.e. transversely of the longitudinal direction of the base plate 590 and to the right in FIG. 7*a*. The displacement of the locking member 501 is continued until the movable sheet retainers 533, 535 are moved to the right, i.e. in the direction of the arrow F, to such an extent that the bearing pins 560, 561 come to lie beneath the detent groove 597. The movable sheet retainers 533, 535 are now rotatably mounted in the base plate 590 about an axis defined by the pins 560, 561 and by displacement of the locking member 501 in the direction of the arrow E can be closed with respect to the stationary sheet retainers 536*a*, 536*b* or on displacement of the locking member 501 opposite the direction of the arrow E can be opened with respect to the stationary sheet retainers 536*a*, 536*b*.

As indicated in FIG. 7*c* the locking member 501 can be provided at its surface along the slots 502*a*, 502*b* with enlargements 507, 508 which extend laterallY above the slots and effect a stronger application of the movable sheet retainers and avoid material fatigue with respect to the locking member in the region of its slots 502*a*, 502*b*. To avoid unintentional pushing of the locking member 501 out in the embodiment of FIGS. 7*a* to 7*c* at the edge of the locking member denoted by 503 automatically erecting detent elements or detent hooks 510, 511 are provided which stand out inclined oppositely to the direction of the arrow E and as clearly shown in FIG. 7*a* prevent displacement of the locking member oppositely to the direction of the arrow E over the guide rails 510*a* or 510*c* because they effect a locking with respect to said guide rails. Possibly a corresponding detent element can be provided on the guide edge of the locking member 501 opposite the guide edge 503, and is indicated in FIG. 7*a* by the reference numeral 512. It is emphasized that the guide or control slots 502*a*, 502*b*, seen in FIG. 7*a*, are closed at their upper sides whilst at their lower sides they are open outwardly through the guide portions 504*a*, 504*b*. The slots 502*a*, 502*b* extend as in the embodiments described above in FIG. 7*a* from the top inclined downwardly and outwardly to the locking member 501 where they merge into the guide portions 504*a*, 504*b*.

As described in conjunction with the embodiments of FIGS. 1 to 5, in the embodiments of FIGS. 6 to 7 as well holding-down clamps 4 are used. Fundamentally, in all embodiments two or more than two movable sheet retainers can be used although with regard to the embodiment of FIGS. 6 and 7 only two movable sheet retainers or one movable sheet retainer are shown.

All parts of the filing device described can be made from plastic or from metal or combined from metal and plastic.

As the above remarks show, in particular as regards the embodiments of FIGS. 6 and 7 a substantially simplified introduction of the movable sheet retainers is ensured and this has a particularly advantageous effect as regards production costs of the filing device according to the invention.

Hereinafter a further modification of the filing device will be described in conjunction with FIGS. 8*a* to 8*c*. This filing device represents a modification of the filing device described in conjunction with FIGS. 1 and 2, identical parts compared with FIGS. 1 and 2 being provided with identical reference numerals. In contrast to FIG. 1 the base plate 1 is provided in the region of the connecting portion 603*c* with a cutout as clearly apparent from FIG. 8*a*. The movable sheet retainer 603 is provided centrally or eccentrically of the connecting portion 603*c* with at least one stirrup-shaped portion 603*i* which projects from the axis of the connecting portion 603*c* and which in the embodiment according to FIG. 8*b* is made substantially rectangular and with the leg portions 603*g*, 603*f* in said embodiment includes a right angle with the remaining connecting portions denoted by 603$c_1$, 603$c_2$. The stirrup-shaped portion 603*i* may also have a substantially triangular shape or the shape of a bow. To permit a pivot motion of the movable sheet retainer 603 with respect to the base plate 601 the latter must be provided with a cutout at least in the region in which the portion 603*i* comes to lie in order to enable pivoting of said bow region 603*i* with respect to the base plate 601. The base plate 601 in FIG. 8*a* is accordingly cut out not only in a region corresponding to the portion 603*i* but also in the region of the legs 603$c_1$, 603$c_2$, giving a substantially T-shaped cutout. Said cutout is denoted by 602*a* in FIG. 8.

A corresponding cutout 601*b* is provided in the locking member 602, said cutout 601*b* for the movable sheet retainer shown in FIG. 8*b* having a length at least corresponding to the length of the portion 603*i* and a width corresponding to the length of the portion 603*f* or 603*g* and accordingly preferably having a rectangualar form corresponding to FIG. 8*c*. As in the embodiment according to FIG. 2 for displacement of the locking member 602 slots 602*a*, 602*b* extending inclined to the axis of the locking member 602 are provided and are open at 602*c*, 602*d* towards the left edge of the locking member 602 in FIG. 8*c*. Said openings 602*c*, 602*d* permit a simpler assembly of the movable sheet retainer 603 with respect to the base plate 601 together with the locking member 602. As apparent from FIG. 8*c* the slot 602*b* can also open into the cutout 602*b*. When the spacing between the ends 603*a*, 603*b* is substantially greater than shown in FIGS. 1, 2 and 8*b*, the slots 602*a*, 602*b* assume with their one end, not open to the outside, a greater distance from the cutout 601*b* and accordingly the slit 602*b* need also not open into the cutout 601*b*.

In the embodiment of FIGS. 8*a* to 8*c* it is essential that the stirrup-shaped portion 603*i* comes to lie in a plate $E_2$ which includes a slight angle to the plane $E_1$. The plane $E_1$ is defined by the two ends 603*a*, 603*b*, i.e. said ends 603*a*, 603*b* lie in the plane $E_1$. Under this condition with the movable sheet retainer 603 closed in accordance with FIG. 8*a* and the ends 603*a*, 603*b* thereof resting on the stationary sheet retainers 606*a*, 606*b* it is achieved that the stirrup-formed portion 603*i* stands up slightly and by the locking member 602 a pressure is exerted on the portion 603*i*,ensuring an application pressure of predetermined magnitude between the ends 603*a*, 603*b* and the associated stationary sheet retainers. If the application pressure is to be made greater the portion 603*i* is shaped to stand up more in the direction towards the ends 603*a*, 603*b* than with a lesser application pressure.

Otherwise the filing device has the construction already described in conjunction with FIGS. 1 and 2; in addition, for holding down sheets the holding-down clamp 604 illustrated in FIG. 2 can be used. The filing device according to FIGS. 608*a* to 608*c* is suitable in poarticular for use in document files of relatively large thickness, i.e. for collecting a high stack of sheets with correspondingly relatively long stationary sheet retainers 606*a*, 606*b*.

It is apparent from the above remarks that in the embodiment of FIGS. 8*a* to 8*c* it is important that the movable sheet retainer has a stirrup-shaped portion 6038 projecting out of the axis of the connecting portion 603*c* and extending slightly in the direction towards the free ends 603*a*, 603*b* in order to obtain the particular desired application pressure between the ends 603*a*, 603*b* and the stationary sheet retainers 606*a*, 606*b* by said portion 603*i* being pressed downwardly by the locking member 602.

According to a modification of the parts illustrated in FIGS. 8*a* and 8*c* the locking member 602 is downwardly bevelled at its right edge illustrated in FIG. 8*c* and indicated by the dashed line 605 whilst at the same time the guide rail 610*b*, 610*d* is given a upward bevelling corresponding to the dashed line 602. These bevellings 605, 606 make it possible to insert the locking member from above into the guide rails 610*a*, 610*b*, 610*c*, 610*d* for example by inserting the locking member 602 with its left edge illustrated in FIG. 8*c* beneath the guide rail portions 610*a*, 610*c* and thereafter pressing said locking member 602 with its right edge in FIG. 8*c* via the facing bevellings downwardly into the guide rails 610*b*, 610*d*. The two ends 658, 659 provided for handling and extending inclined outwardly and upwardly with respect to the locking member 602 may possibly be omitted, particularly when the locking member 602 is to be inserted from the end side of the base plate 601 into the associated guide rails 610*a*, 610*b*, 610*c*, 610*d*.

According to a further modification of the locking member 602 shown in FIG. 8*c* said member 602 is provided at its left guide edge, or the right guide edge according to FIG. 8*c*, with projections 609, 610 which restrict the inserted locking member 602 as regards its movement relatively to the guide rails 610*a* to 610*d*. With these projections 609, 610 a limitation of the opening and/or closure travel of the movable sheet retainer 603 can be achieved. The projections 609, 210 may however also be designed so that the locking member can be forced beyond said projections, for example for insertion or pulling out from the guide rails.

I claim:

1. A filing device for document files, comprising:

a base plate whose upper surface defines spaced-apart first and second planes, said first plane defining at least two openings;

at least two stationary sheet retainers projecting upright from said second plane;

at least one movable sheet retainer having ends adapted to pass through said openings to engage at least a portion of said stationary sheet retainers;

a locking member whose lower surface defines spaced-apart first and second planes sized to overlie at least a portion of said first and second planes of said base plate, said first plane of said locking member including at least one through guide slot inclined with respect to a longitudinal axis of said locking member and sized to receive therethrough a portion of a said movable sheet retainer;

guide means, disposed on said upper surface of said base plate, for receiving and restricting movement of said locking member relative to said base plate substantially along the longitudinal axis of said locking member;

longitudinal movement of said locking member with respect to said base plate locking and unlocking a said moveable sheet retainer passing therethrough for closing and opening the filing device.

2. The device of claim 1, wherein said base plate is plastic.

3. The device of claim 1, wherein said locking member includes guide slots disposed parallel to one another.

4. The device of claim 1, wherein said guide means is disposed on said first surface of said base plate.

5. The device of claim 1, wherein a said guide slot includes a widened bore.

6. The device of claim 1, wherein a said moveable sheet retainer is inserted through said openings in said base plate and defines a connecting portion extending beneath said base plate.

7. The device of claim 1, wherein a said moveable sheet retainer includes at least two separated members having the form of a "U".

8. The device of claim 1, wherein said guide means includes a guide passage formed in said base plate, said guide passage defining a lateral opening for passage of an end of a said movable sheet retainer.

9. The device of claim 8, wherein said guide slot is provided on a surface of said locking member facing said lateral opening.

10. The device of claim 1, wherein said base plate includes a bearing section for mounting a said movable sheet retainer.

11. The device of claim 1, wherein said locking member includes curved guide slots.

12. The device of claim 1, wherein said base plate and locking member are plastic, and wherein said stationary sheet retainers and said movable sheet retainer are metal.

13. The device of claim 1, wherein said stationary sheet retainers are adapted to receive a portion of said movable sheet retainer.

14. The device of claim 1, wherein said movable sheet retainer includes two members, each having bearing pins defining an axis of rotation for said movable sheet retainer, and wherein said base plate includes bearing portions for engaging said two members.

15. The device of claim 1, wherein said guide slots opens outwardly with respect to said locking member.

16. The device of claim 1, wherein said guide means includes a guide rail.

* * * * *